US012247770B2

(12) United States Patent
Appler et al.

(10) Patent No.: US 12,247,770 B2
(45) **Date of Patent: *Mar. 11, 2025**

(54) SYSTEMS, DEVICES, AND METHODS FOR FLUID MANAGEMENT

(71) Applicant: Alltemp Products Company Limited, Pickering (CA)

(72) Inventors: Paul Clarence Appler, Windsor (CA); Jesse Richard Homenuik, Windsor (CA); Norma Hill, Windsor (CA)

(73) Assignee: Alltemp Products Company Limited, Pickering (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/204,715

(22) Filed: Jun. 1, 2023

(65) Prior Publication Data

US 2023/0304710 A1 Sep. 28, 2023

Related U.S. Application Data

(60) Continuation of application No. 17/178,769, filed on Feb. 18, 2021, now Pat. No. 11,703,260, which is a division of application No. 16/833,074, filed on Mar. 27, 2020, now Pat. No. 10,928,111, which is a division of application No. 15/261,320, filed on Sep. 9, 2016, now Pat. No. 10,605,505.

(Continued)

(51) Int. Cl.
*F25B 45/00* (2006.01)

(52) U.S. Cl.
CPC ..... *F25B 45/00* (2013.01); *F25B 2345/001* (2013.01)

(58) Field of Classification Search
CPC ..... F25B 45/00; F25B 2345/001; F25B 2345/006
See application file for complete search history.

(56) References Cited

U.S. PATENT DOCUMENTS 3,144,049 A 8/1964 Irwin
3,963,212 A 6/1976 Mullins
(Continued)

FOREIGN PATENT DOCUMENTS

WO WO2015/149157 10/2015

OTHER PUBLICATIONS

Amazon, Blue Devil Products, Red Angel A/C Stop Leak & Conditioner, 2023 (7 pages).

(Continued)

*Primary Examiner* — Jonathan Bradford
(74) *Attorney, Agent, or Firm* — Dentons US LLP

(57) ABSTRACT

A container has a first end portion hosting a first fitting and a second end portion hosting a second fitting. The container contains a first fluid between the first end portion and the second end portion. The first fitting directly and detachably connects to a service port of a system that is running, where the system is an air conditioning system or a refrigeration system, and where the system is residential or commercial. The second fitting detachably connects to a source of a second fluid, where the first fluid is input into the service port of the system that is running from the first fitting directly and detachably connected to the service port of the system that is running when urged via the second fluid entering the container from the source via the second fitting while the system is running.

20 Claims, 10 Drawing Sheets

Related U.S. Application Data

(60) Provisional application No. 62/217,534, filed on Sep. 11, 2015.

(56) References Cited

U.S. PATENT DOCUMENTS

| | | | |
|---|---|---|---|
| 5,167,140 | A | 12/1992 | Cooper et al. |
| 5,975,151 | A | 11/1999 | Packo |
| 6,360,554 | B1 | 3/2002 | Trachtenberg |
| 7,077,149 | B2 | 7/2006 | Kalley et al. |
| 7,127,902 | B1 | 10/2006 | Levy |
| 2005/0081914 | A1 | 4/2005 | Kalley |
| 2008/0156002 | A1 | 7/2008 | Willis et al. |
| 2011/0167841 | A1 | 7/2011 | Appler et al. |
| 2013/0086934 | A1 | 4/2013 | Appler |
| 2013/0118187 | A1 | 5/2013 | Carrubba |
| 2015/0149157 | A1 | 5/2015 | Atti |

OTHER PUBLICATIONS

International Search Report dated Nov. 18, 2016 in corresponding PCT Application PCT/CA2016/051069 filed Sep. 9, 2016 (3 pages).
Rectorseal, AC Leak Freeze, 2023 (2 pages).
Rectorseal, AC Leak Freeze R 0.5 oz. Cam Shell, 2023 (2 pages).

SYSTEMS, DEVICES, AND METHODS FOR FLUID MANAGEMENT

CROSS-REFERENCE TO RELATED PATENT APPLICATIONS

This patent application is a Continuation of U.S. Utility patent application Ser. No. 17/178,769 filed 18 Feb. 2021; which is a Divisional of U.S. Utility patent application Ser. No. 16/833,074 filed 27 Mar. 2020, now U.S. Pat. No. 10,928,111 issued 23 Feb. 2021; which is a Divisional of U.S. Utility patent application Ser. No. 15/261,320 filed 9 Sep. 2016, now U.S. Pat. No. 10,605,505 issued 31 Mar. 2020; which claims a benefit of U.S. Provisional Patent Application 62/217,534 filed 11 Sep. 2015; each of which is incorporated by reference herein for all purposes.

TECHNICAL FIELD

This disclosure is related to fluid management.

BACKGROUND

In this disclosure, where a document, an act, and/or an item of knowledge is referred to and/or discussed, then such reference and/or discussion is not an admission that the document, the act, and/or the item of knowledge and/or any combination thereof was at a priority date, publicly available, known to a public, part of common general knowledge, and/or otherwise constitutes any prior art under any applicable statutory provisions; and/or is known to be relevant to any attempt to solve any problem with which this disclosure may be concerned with. Further, nothing is disclaimed.

There is a difficulty in introducing a fluid into an air conditioning system. Likewise, there is a difficulty in introducing a fluid into a refrigeration system. Accordingly, there is a desire to address at least one of such difficulties.

SUMMARY

This disclosure may at least partially address at least one of above difficulties. However, this disclosure can prove useful to other technical areas. Therefore, various claims recited below should not be construed as necessarily limited to addressing any of the above inefficiencies.

In an embodiment, a device comprises: a container; a first fitting coupled to the container; and a second fitting coupled to the container, wherein the first fitting is configured for coupling to a first service port of a system and the second fitting is configured for coupling to a second service port of the system such that a fluid can travel from the first service port to the second service port through the container while the system is running, wherein the system comprises at least one of an air conditioning system or a refrigeration system.

In an embodiment, a device comprises a container comprising an energy storing element and a connector, wherein the container contains a fluid, wherein the connector is configured to connect to a service port of a system such that the energy storing element is able to facilitate a discharge of the fluid from the container through the connector into the service port based on a pressure differential in the system, wherein the system comprises at least one of an air conditioning system or a refrigeration system.

In an embodiment, a method comprises inputting a fluid into a tube, wherein the tube comprises a first end portion and a second end portion, wherein the first end portion comprises a two-way valve fitting, wherein the two-way valve fitting is fluidly closed by default, wherein the tube comprises an ambient air distinct from the fluid; outputting the ambient air from the tube such that the fluid remains in the tube; connecting the two-way valve fitting to a service port of a system such that a pressure differential between a service mode of the system and an operating mode of the system forces the fluid into the system from the tube through the two-way valve fitting, wherein the system comprises at least one of an air conditioning system or a refrigeration system.

This disclosure may be embodied in various forms illustrated in a set of accompanying illustrative drawings. Note that variations are contemplated as being a part of this disclosure, limited only by a scope of various claims recited below.

BRIEF DESCRIPTION OF DRAWINGS

The set of accompanying illustrative drawings shows various example embodiments of this disclosure. Such drawings are not to be construed as necessarily limiting this disclosure. Like numbers and/or similar numbering scheme can refer to like and/or similar elements throughout.

Like reference numerals are used throughout the Figures to denote similar elements and features. While aspects of this disclosure will be described in conjunction with the illustrated embodiments, this is not intended to limit this disclosure to such embodiments.

DETAILED DESCRIPTION

Figure 1:
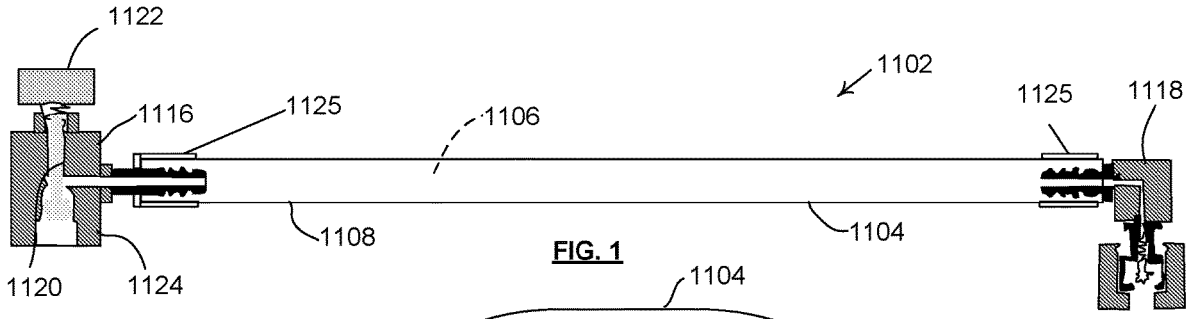
FIG. 1 is a side view of an embodiment of a fluid introduction device according to this disclosure.

This disclosure is now described more fully with a reference to the set of accompanying illustrative drawings, in which example embodiments of this disclosure are shown. This disclosure may, however, be embodied in many different forms and should not be construed as necessarily being limited to the example embodiments disclosed herein. Rather, the example embodiments are provided so that this disclosure is thorough and complete, and fully conveys various concepts of this disclosure to those skilled in a relevant art.

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly couple" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Various terminology used herein is for describing particular example embodiments and is not intended to be necessarily limiting of this disclosure. As used herein, various singular forms "a," an and the are intended to include various plural forms as well, unless a context clearly indicates otherwise. Various terms "comprises," "includes" and/or "comprising," "including" when used in this specification, specify a presence of stated features, integers, steps, operations, elements, and/or components, but do not preclude the presence and/or addition of one or more other features, integers, steps, operations, elements, components, and/or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Example embodiments of this disclosure are described herein with a reference to illustrations of idealized embodiments (and intermediate structures) of this disclosure. As such, variations from various illustrated shapes as a result, for example, of manufacturing techniques and/or tolerances, are to be expected. Thus, various example embodiments of this disclosure should not be construed as necessarily limited to various particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized and/or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" and/or "substantially" refers to a +/−10% variation from a nominal value/term. Such variation is always included in any given value/term provided herein, whether or not such variation is specifically referred thereto.

If any disclosures are incorporated herein by reference and such disclosures conflict in part and/or in whole with this disclosure, then to an extent of a conflict, if any, and/or a broader disclosure, and/or broader definition of terms, this disclosure controls. If such disclosures conflict in part and/or in whole with one another, then to an extent of a conflict, if any, a later-dated disclosure controls.

In some embodiments, this disclosure enables a technology for managing a fluid, such as a liquid or a gas. For example, such management may include sending, receiving, inputting, outputting, containing, storing, or other actions. For example, the fluid may comprise an organosilane, an oil, a UV dye, a colorant, a refrigerant, an oil additive, or others. For example, this disclosure enables a technology for introducing a fluid into a refrigeration system, such as refrigerator, or an air conditioning system, such as a heating, ventilation, and air conditioning (HVAC) system. For example, a device may introduce a fluid such as a refrigerant, whether in a liquid form or a gaseous form, into a refrigeration system or an air conditioning (AC/R) system. The AC/R system includes a first port, such as a service port, and a second port, such as a service port. The device includes a container, a first fitting, and a second fitting. The container contains the fluid to be dispensed. The first fitting connects the container to the first port. The second fitting connects the container to the second port. Resultantly, a path for the fluid is formed through the container from the first port to the second port in order to discharge the fluid from the container and into the AC/R system. Note that although the AC/R system is described as a single system, the AC/R system may be a plurality of distinct systems, whether operating dependently or independently with respect to each other, whether in a single locale or a plurality of distinct locales, whether operated via a single operator or a plurality of distinct operators. Therefore, a refrigeration system and an air conditioning system may be distinct systems. This disclosure applies at least to both. For example, the refrigeration system may be a refrigerator, whether residential, commercial, scientific (biology/chemistry/physics), or others. For example, the air conditioning system may be residential, commercial, vehicle, whether land, air, or marine, or others.

Figure 2:
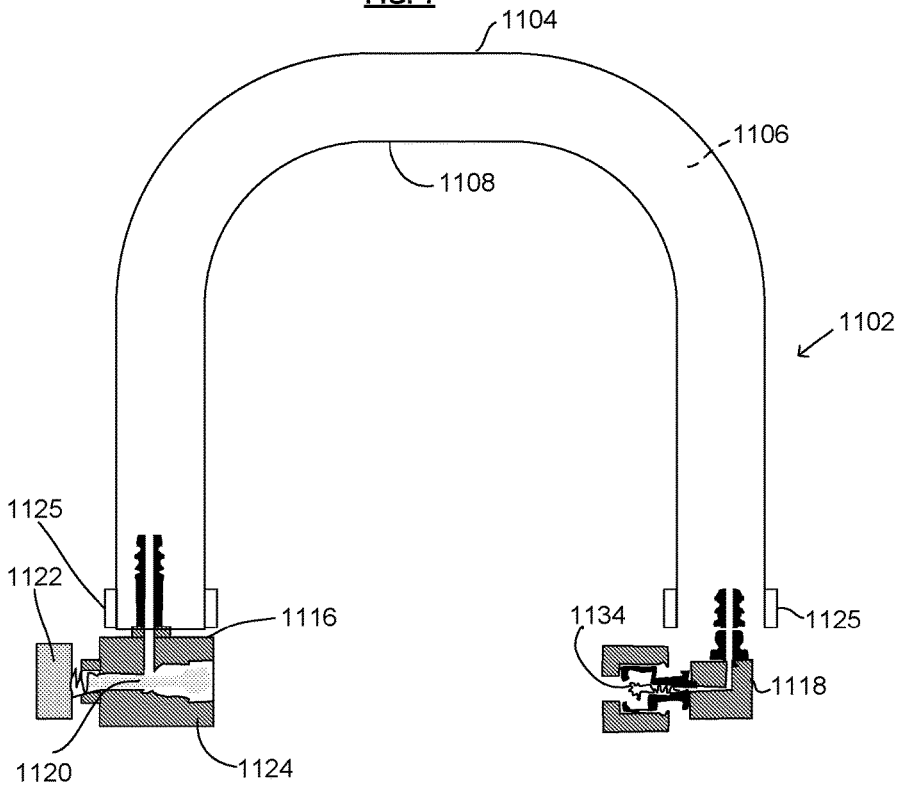
FIG. 2 is a side view of an embodiment of a fluid introduction device according to this disclosure.

FIGS. 1 and 2 illustrate a device 1102 that may be used to store a fluid 1106, such as a liquid or a gas. For example, the fluid 1106 may comprise a refrigerant. The device 1102 may be used to introduce the fluid 1106 into an AC/R system. The device 1102 may be pre-filled with the fluid 1106.

Figure 3:
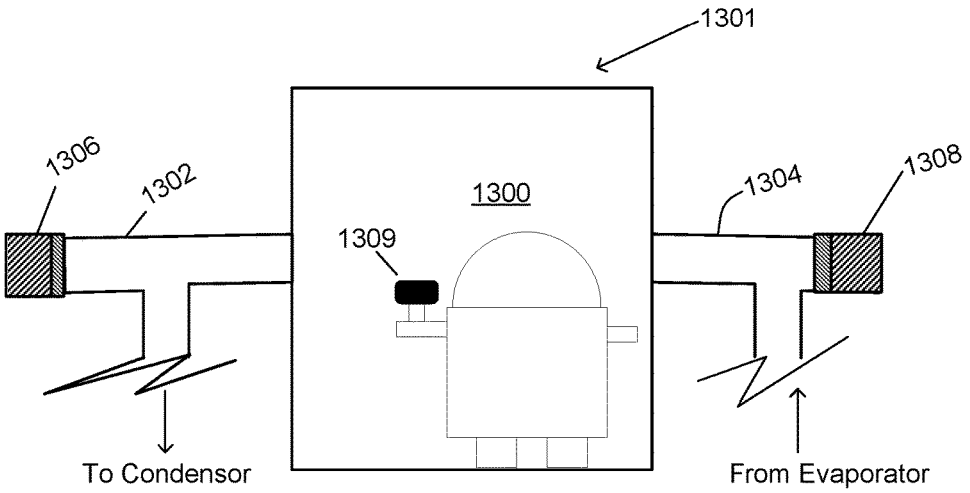
FIG. 3 is a schematic diagram of an embodiment of an air conditioning system or a refrigeration system according to this disclosure.

As shown in FIG. 3, the fluid 1106 may be formulated for an introduction into an AC/R system 1301 (see FIG. 3). The device 1102 may be used with the AC/R system 1301 that includes a compressor 1300 that is located between a high pressure side 1302 and a low pressure side 1304 in a refrigerant flow path, with the refrigerant being in a gaseous form on the low pressure side 1304 and in a liquid form on the high pressure side 1302 or as a hot gas on high side discharge port 1309. The AC/R system 1301 has a low side service fitting or port 1308 on the low pressure side 1304 and a high side service fitting or port 1306 and the hot gas discharge port 1309 on the high pressure side 1302. In some embodiments, each of the service ports 1306, 1308, and 1309 is a male low loss fitting that is sealed by a normally closed valve, such as a Schrader style push valve, which may be spring biased into a normally closed position.

Referring again to FIGS. 1 and 2, the device 1102 includes a fluid storage container 1104 that defines a fluid storage reservoir for the fluid 1106. The container 1104 may be a unitary piece of resilient flexible tubing 1108 that is formed from a transparent or translucent elastomer or a plastic or other polymer tubing reinforced with fiber braiding. In some embodiments, the tubing 1108 may not be reinforced with fiber braiding. In some embodiments, the tubing 1108 may be opaque rather than transparent, in whole or in part. In some embodiments, the container 1104 may be formed from or comprise a rigid material, such as copper, aluminum, an alloy, another other metal or a rigid polymer. In some embodiments, the container 1104 may be formed from or comprise a semi-rigid material, such as a malleable soft metal or a polymer.

Figure 4:
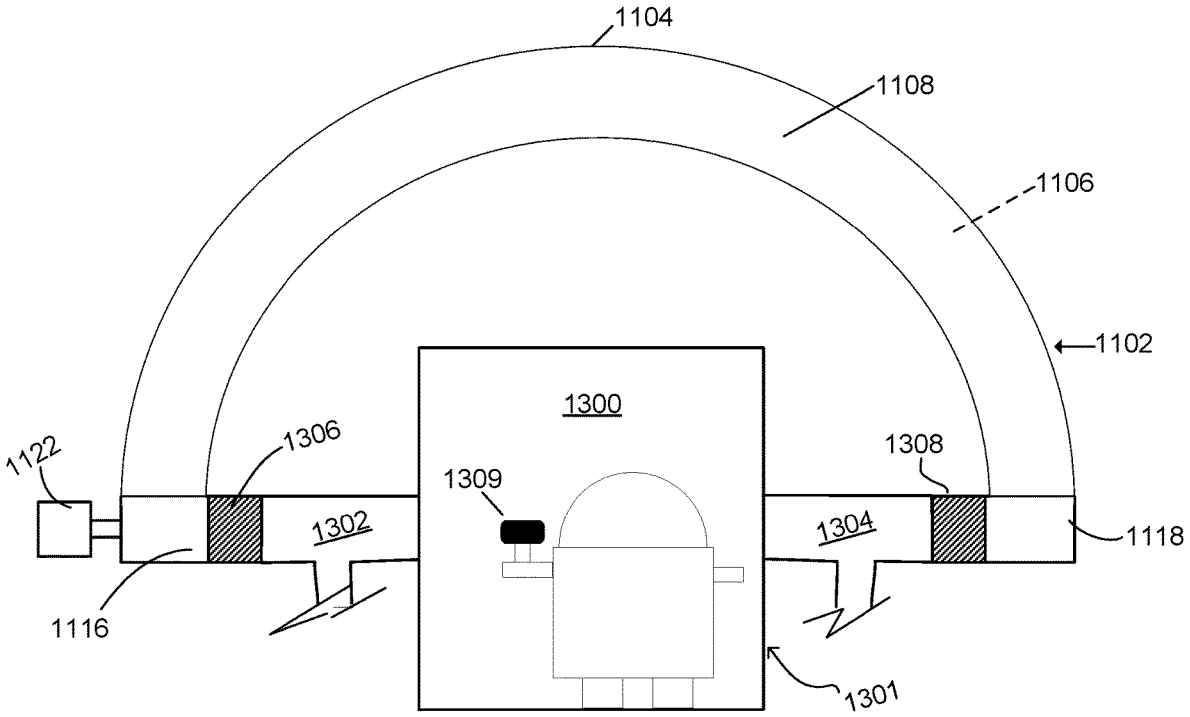
FIG. 4 is a schematic diagram of an embodiment of a fluid introduction device coupled to an air conditioning system or a refrigeration system according to this disclosure.

The tube 1108 has a first end portion and a second end portion. The device 1102 includes a first fitting 1116 at one end of tubing 1108, such as at the first portion, and a second fitting 1118 at the other end of the tubing 1108, such as the second portion. As seen in FIG. 4, the fitting 1116 is configured for connecting one end of the container 1104 of device 1102 to the high pressure or high side service port 1306 of AC/R system 1301, such as mechanically or fluidly, and the second fitting 1118 is configured for connecting the other end of the container 1104 to the service port 1308 of the AC/R system 1301, such as mechanically or fluidly. The fitting 1116 is also configured for connecting the container 1104 of the device 1102 to the high pressure or hot gas discharge port 1309 of AC/R system 1301, such as mechanically or fluidly.

The fitting 1118 can be a low loss fitting configured to thread onto the service port 1308. The fitting 1118 may include a normally closed valve mechanism that cooperates with the service port 1308.

Figure 5:
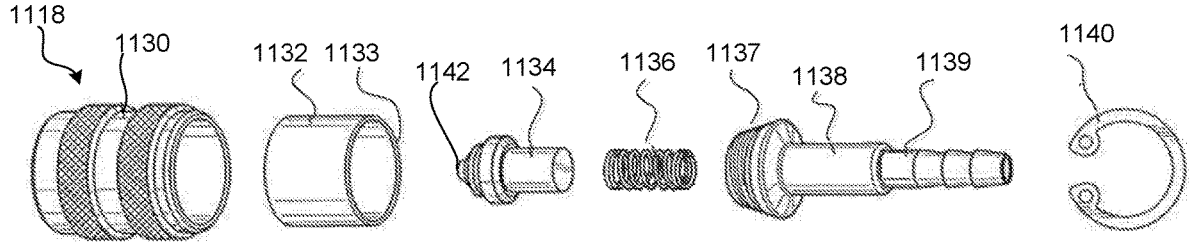
FIG. 5 is an exploded perspective view of an embodiment of a discharge fitting of a fluid introduction device according to this disclosure.

As shown in FIG. 5, the fitting 1118 can include an internally threaded valve housing 1130 for threading onto the service port 1308, an upper valve sleeve 1132 with a valve seat 1133, a depressor 1134, a spring 1136, a lower valve sleeve 1138 with a valve seal 1137, a hose barb 1139, and a snap ring 1140. When the valve housing 1130 is screwed onto a service port, such as at least one of the service ports 1306, 1308, or 1309, the depressor 1134 interacts with a corresponding valve activator in the service port to displace the valve seal 1137 of the lower valve sleeve 1138 from the valve seat 1133, as defined by the upper valve sleeve 1132, and permit the fluid to flow through the fitting 1118. A height of the nub 1142 that is provided on an end of the depressor 1134 defines a size of a flow opening through the fitting 1118 and can be calibrated to provide a desired fluid flow rate in accordance with an application of the device 1102.

As shown in FIGS. 1 and 2, a crimp clamp 1125 is used to secure the fitting 1118 to the tubing 1108 by securing the hose barb 1139 of the valve sleeve 1138 to the container 1104. In some embodiments, the depressor 1134 interacts with the normally closed valve of the service port 1308 such that securing the fitting 1118 to the service port 1308 establishes a fluid communication between an interior of the container 1104 and the low side 1304 of the compressor 1300 shown in FIG. 4.

The fitting 1116 can be a push button valve fitting or a low loss fitting configured to thread onto the service port 1306 or the port 1309. The fitting 1116 includes a normally closed valve mechanism that cooperates with the service port 1306 or the high side discharge port 1309.

Figure 6:
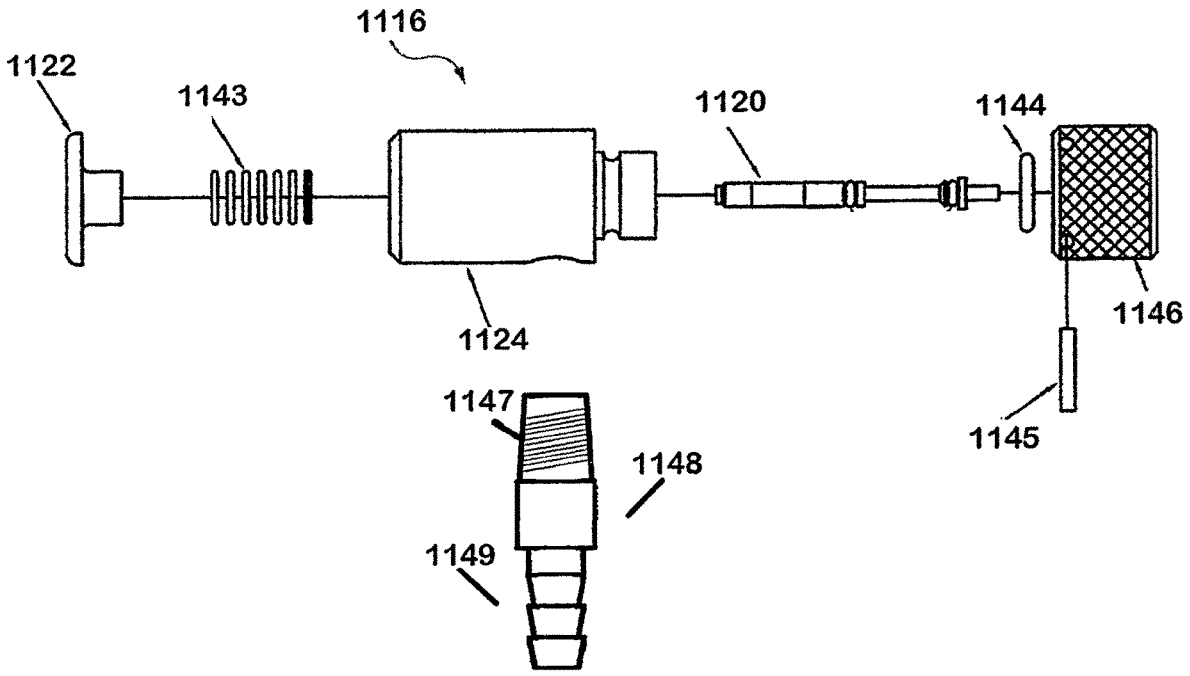
FIG. 6 is an exploded side view of an embodiment of a control fitting of a fluid introduction device according to this disclosure.

As shown in FIG. 6, the fitting 1116 can include a housing 1124 to contain an internal poppet 1120 and an O-ring 1144 to form a compressed seal against a Schrader style push valve, a push button 1122, a spring 1143, a thread 1147, such as an ⅛th male National Pipe Thread (NPT) thread, a valve sleeve 1148, a hose barb 1149, and an internally threaded valve fitting 1146. The valve fitting 1146 is connected to the housing 1124 via a roll pin 1145 allowing the fitting 1146 to rotate and thread on the high side service port 1306 or the hot gas discharge port 1309. The poppet 1120 is threaded into the push button 1122, so that when the push button 1122 is manually depressed, the poppet 1120 interacts with a corresponding valve activator in a service port, such as the port 1306 or the port 1309, to permit a fluid flow through the fitting 1116 and into the container 1104, through a side port bore and the thread 1147 on the valve sleeve 1148.

As shown in FIGS. 1 and 2, the crimp clamp 1125 is used to secure the fitting 1116 to the tubing 1108 by securing the hose barb 1149 of the valve sleeve 1148 to the container 1104. In some embodiments, the high side fitting 1116 includes the housing 1124 for securing the high side fitting 1116 to the high side port 1306 or the high side discharge port 1309 of the AC/R system 1301, with a normally closed valve and the poppet 1120 acting as a seal between the container 1104 and the fitting 1116.

As shown in FIG. 4, the poppet 1120 includes the spring 1143 biased into a closed position. The poppet 1120 also includes the push button 1122 to allow a user to manually depress the poppet 1120 into an open position, such as via a manual push button activator. The push button 1122 depresses the poppet 1120 and thereby establishes a fluid communication between the container 1104 and the high pressure side 1302 of the compressor 1300.

In one mode of operation, the device 1102 is used to introduce the fluid 1106 into the AC/R system 1300, as shown in FIGS. 1 to 4. Note that the AC/R system 1301 may remain operating throughout such introduction, such as via conditioning air. For example, the AC/R system 1301 may not need to be placed into a service mode and may keep operating in an operating mode, such as a normal air conditioning mode.

In a first step, a user secures the low side fitting 1118 of the device 1102 to the service port 1308 of AC/R system 1301, which causes a normally closed valve of the low side fitting 1118 and a normally closed valve of the service port 1308 to be moved into an open state, thereby establishing a fluid communication between an interior of the container 1104 and the AC/R system low pressure side 1304.

In a second step, a user secures the high side fitting 1116 of device 1102 to the high side service port 1306 or the hot gas discharge port 1309 of the AC/R system 1301. Note that since the poppet 1120 employs a manual activation technology, a mere connection of the high side fitting 1116 to the high side service port 1306 or the hot gas discharge port 1309 may not activate the poppet 1120 of the fitting 1116, and likewise may not activate a valve of the service port 1306, and thus may not establish a flow connection between the container 1104 and the high pressure side 1302. In some embodiments, such a feature may effectively minimize or mitigate against an accidental escape of a high pressure refrigerant onto a hand or a body part of a user during a coupling process. In some embodiments, the high side fitting 1116 may be secured directly to a refrigerant cylinder, which may be used for charging the AC/R system 1301. In some embodiments, an order of the first and second steps described above can be reversed, such as the second step precedes the first step.

In a third step, a user depresses the push button 1122 of the valve fitting 1116, thereby causing the poppet 1120 to open a flow path to the container 1104 and to also activate a valve of the high side service port 1306 or the hot gas discharge port 1309. This causes a fluid path to be established through the container 1104 between the high pressure side flow path 1302 and the low pressure side 1304 of the AC/R system 1301. Consequently, a pressure differential between a pair of ends of the container 1104, such as the first end portion and the second end portion, causes a refrigerant fluid from the AC/R system 1301 to enter the interior of the container 1104 through the fitting 1116 and displace the fluid 1106 stored in the interior of the container 1104 so that the fluid 1106 is discharged from the container 1104 and injected into the AC/R system 1301 through the service port 1308. In some embodiments, the container 1104 is transparent or translucent so that a user can see when the fluid 1106 is fully discharged. In some embodiments, an assumption is made that a full discharge has occurred after the valve push button 1122 has been depressed for a predetermined duration. Once discharge of the fluid 1106 is complete, a user releases the push button 1122, which causes the poppet 1120 to close and also causes a valve of the high side service port 1306 or the hot gas discharge 1309 port to close.

In a forth step, a user disconnects the fittings 1116, 1118 of the device 1102 from the hot gas discharge port 1309 or the service ports 1306, 1308 of the AC/R system 1301.

In some embodiments, the fittings 1116 and 1118 are reversed, with a manually activated valve, such as via the push button 1122, being on the low pressure side 1304 of the device 1102.

An example of a method of using a device 1103 is described with a reference to FIGS. 1 to 7. The device 1103 may be used to introduce a fluid, such as a liquid or a gas, such as a refrigerant, to the AC/R system 1301. Note that the AC/R system 1301 may remain operating throughout such introduction, such as via conditioning air. For example, the AC/R system 1301 may not need to be placed into a service mode and may keep operating in an operating mode, such as a normal air conditioning mode.

In a first step, a user secures one of the fittings 1118 of the device 1103 to the service port 1308 of AC/R system 1301. Such securing, such as via fastening or mating, causes a normally closed valve of the fitting 1118 and a normally closed valve of the service port 1308 to be moved into an open state, thereby establishing a fluid communication between the interior of the container 1104 and a low pressure refrigerant flow path of the AC/R system 1301.

In a second step, a user secures one of the fittings 1118 of the device 1103 to the service port 1306 or the hot gas discharge port 1309 of the AC/R system 1301. Such securing, such as via fastening or mating, causes a normally closed valve of the fitting 1118 and a normally closed valve of the service port 1306 or the hot gas discharge port 1309 to be moved into an open state, thereby establishing a fluid communication between the interior of the container 1104 and a high pressure or hot gas refrigerant flow path of the AC/R system 1301. In some embodiments, an order of the first and second steps described above can be reversed, such as the second step precedes the first step.

An example of a method of using a device 1105 is described with a reference to FIGS. 1 to 8. The device 1105 may be used to introduce a single or multiple fluids, such as a liquid or a gas, such as a refrigerant, to the AC/R system 1301. Note that the AC/R system 1301 may remain operating throughout such introduction, such as via conditioning air. For example, the AC/R system 1301 may not need to be placed into a service mode and may keep operating in an operating mode, such as a normal air conditioning mode.

Figure 7:
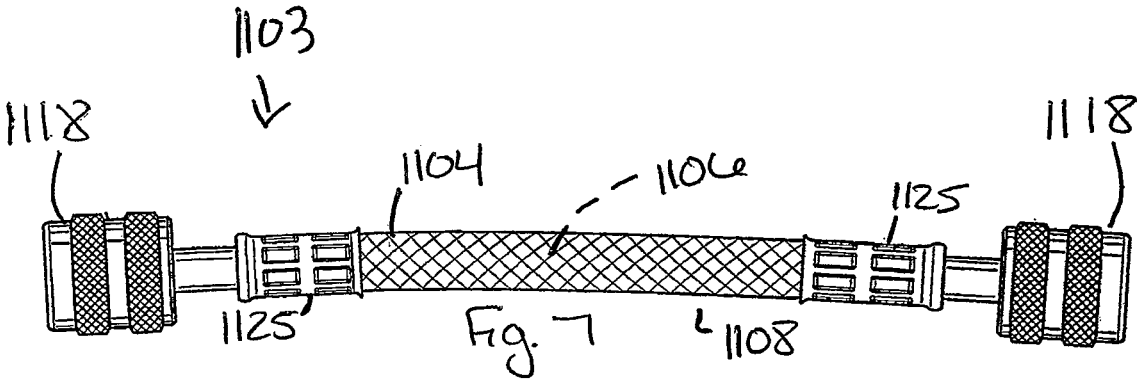
FIG. 7 is a side view of an embodiment of a fluid introduction device with two automatic discharge fittings according to this disclosure.
Figure 8:
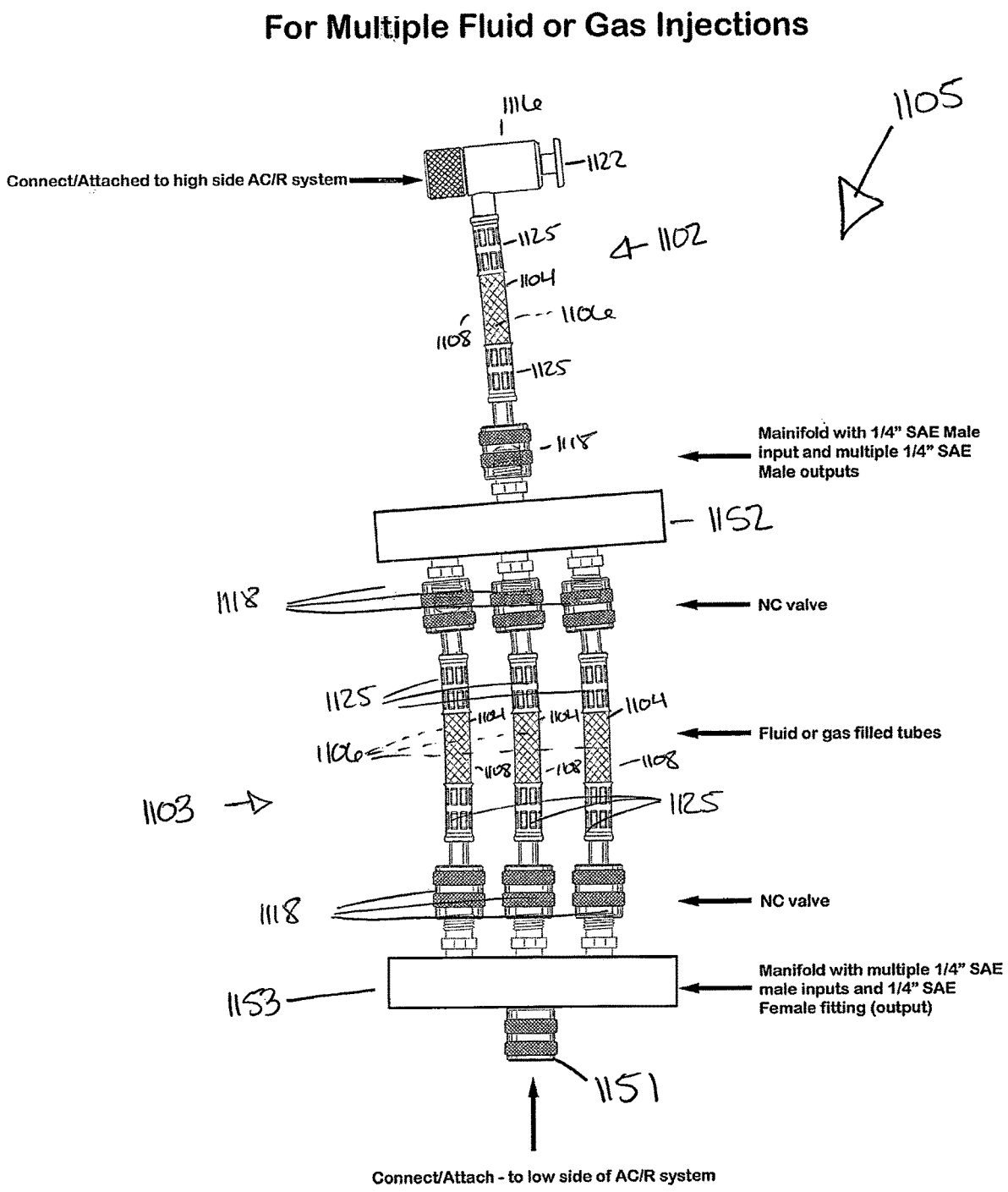
FIG. 8 is a schematic diagram of an embodiment of a multiple injection system using a fluid introduction device according to this disclosure.

As shown in FIG. 8, the device 1105 includes the device 1102, as shown in FIG. 1, an input manifold 1152, the device 1103, as shown in FIG. 7, and an output manifold 1153. The fitting 1118 of the device 1102 connects, whether mechanically or fluidly, to the input manifold 1152 which contains a plurality of male input slots, such as three available ¼ inch Society of Automotive Engineers (SAE) male input slots, although more or less can be used as well, whether two or four. Note that single or multiple units of the device 1103 can be coupled, such as via attaching or fastening, to the input manifold 1152 and the output manifold 1153 via connecting the fitting 1118 of the device 1103 to one or more available slots, such as three slots.

In a first step, a user assembles the device 1105 by securing the fitting 1118 of the device 1102 to the input manifold 1152. As exemplarily illustrated in FIG. 8, one, two, or three units of the device 1103 are secured to the input manifold 1152 slots by coupling, such as via attaching, such as via fastening or mating, one side of the fittings 1118 of the device 1103 to the male input slots, such as various ¼" male SAE input slots. The fittings 1118 of the device 1103 are coupled on another side, such as via attaching, such as via fastening or mating, to the output slots on the output manifold 1153, such as various ¼" male SAE output slots. Note that at least one or all of such couplings, such as fluid or mechanical connections, may cause a normally closed valve of the fitting 1118 to be switched, such as via moving, into an open state.

In a second step, a user secures a fitting 1151 of the device 1105 to the low side service port 1308 of AC/R system 1301. Such securing, such as via fastening or mating, causes a normally closed valve of the fitting 1151 and a normally closed valve of the service port 1308 to be switched, such as via moving, into an open state, thereby establishing a fluid communication between the interior of the container 1104 and a low pressure refrigerant flow path of the AC/R system 1301.

In a third step, a user secures the fitting 1116 of the device 1105 to the high side service port 1306 or the hot gas discharge port 1309 of the AC/R system 1301. As the poppet 1120 employs a manual activation technology, a mere connection of the fitting 1116 to the service port 1306 or the hot gas discharge port 1309 may not activate the poppet 1120 of fitting 1116, and likewise may not activate a valve of the service port 1306, and thus may not establish a flow connection between the container 1104 and a high side refrigerant flow path. In some embodiments, such a feature may effectively minimize or mitigate against an accidental escape of a high pressure refrigerant onto a hand or a body part of a user during a coupling process. In some embodiments, an order of the second step and the third step can be reversed, such as the third step precedes the second step.

In a fourth step, a user depresses the push button 1122 of the fitting 1116 of the device 1102, thereby causing the poppet 1120 to open a fluid flow path to the container 1104 and to activate a valve of the service port 1306 or the hot gas discharge port 1309. Such action causes a fluid flow path to be established through the device 1105 between the high pressure side 1302 and the low pressure side 1304 of the AC/R system 1301. A pressure differential between various ends of the device 1105 causes a refrigerant fluid, such as a liquid or a gas, from the AC/R system 1301 to enter an interior of the device 1105 though the fitting 1116 and displace the fluid 1106 stored in the interior of the devices 1102, 1103 so that the fluid 1106 is discharged from the container 1104 and injected into the AC/R system 1301 through the service port 1308. In some embodiments, the container 1104 is transparent or translucent so that a user can see when the fluid 1106 is fully discharged. In some embodiments, an assumption is made that a full discharge has occurred after the push button 1122 has been depressed for a predetermined duration, such as under one minute, although less than one minute or more than one minute is possible, such as under five minutes. Once a discharge of the fluid 1106 is complete, a user releases the push button 1122, which causes the poppet 1120 to close and also causes a valve of the service port 1306 or the hot gas discharge port 1309 to close.

In some embodiments, the device 1105 may contain four different fluid chambers, although more or less are possible, thereby allowing four different fluid 1106 compositions to be injected, whether a liquid or a gas. The fluid 1106 comprises of either a same composition or different compositions allowing for a semi-automatic or automatic mixing of chemical solutions and direct delivery into the AC/R system 1301. In such embodiments, the device 1105 comprises a four-part solution of fluid 1106 which activates internally within the AC/R system 1301 to allow a longer shelf life. A fluid flow path is formed through the container 1104 from the fitting 1116 through the device 1105 to the fitting 1151 to mix and discharge the fluid from the container 1104 and into the AC/R system 1301. For example, a method may comprise inputting one or multiple fluids into the AC/R system 1301, wherein a device, as disclosed herein, may comprise an input manifold and an output manifold.

In some embodiments, a non-reactive fluid, such as a liquid or a gas, may be used. Consequently, FIGS. 9 to 13 relate to further embodiments of systems, devices, and methods for storing a fluid, which may be a reactive fluid or a non-reactive fluid, whether a liquid or a gas, and subsequently introducing that fluid into a refrigeration system or air conditioning system.

Figure 9:
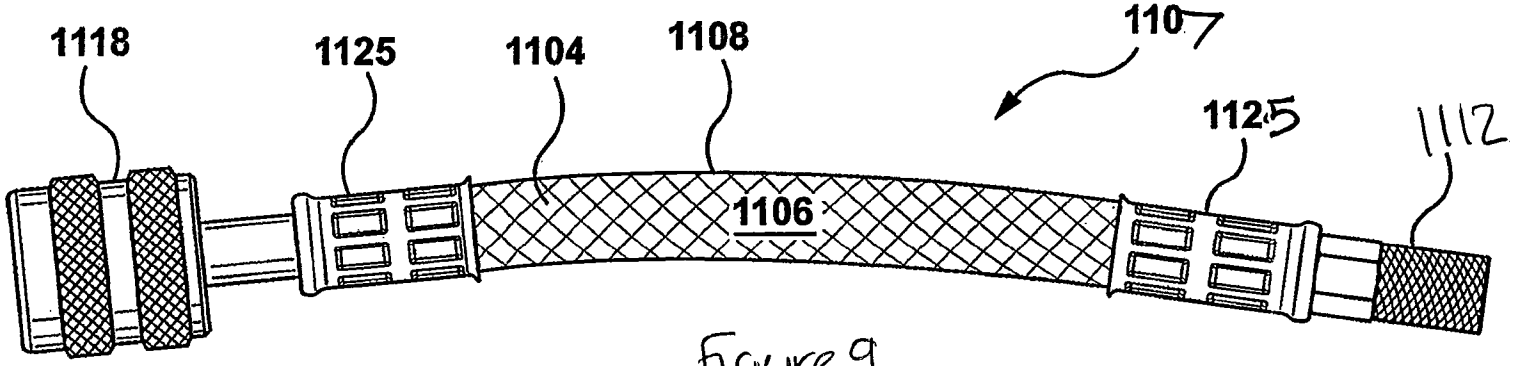
FIG. 9 is a side view of an embodiment of a fluid introduction device for introducing a fluid into a refrigeration system or an air conditioning system according to this disclosure.

For example, FIG. 9 illustrates a fluid storage and introducing device 1107. The device 1107 may be pre-filled with the fluid 1106 that is formulated for an introduction into a refrigeration system or an air conditioning system.

The device 1107 includes the container 1104 that defines a fluid storage reservoir. The container 1104 can be a unitary piece of resilient flexible tubing 1108 that is formed from transparent or translucent elastomer or plastic or other polymer tubing reinforced with fiber braiding. In some embodiments, the tubing 1108 may not be reinforced with fiber braiding. In some embodiments, the tubing 1108 may be opaque rather than transparent. The device 1107 includes a bleed valve fitting 1112 at one end of the tubing 1108 and a discharge/fill fitting 1118 at another end of the tubing 1108 for connecting the device 1107 to a fluid filling station and to an air conditioning system or a refrigeration system.

Figure 10:
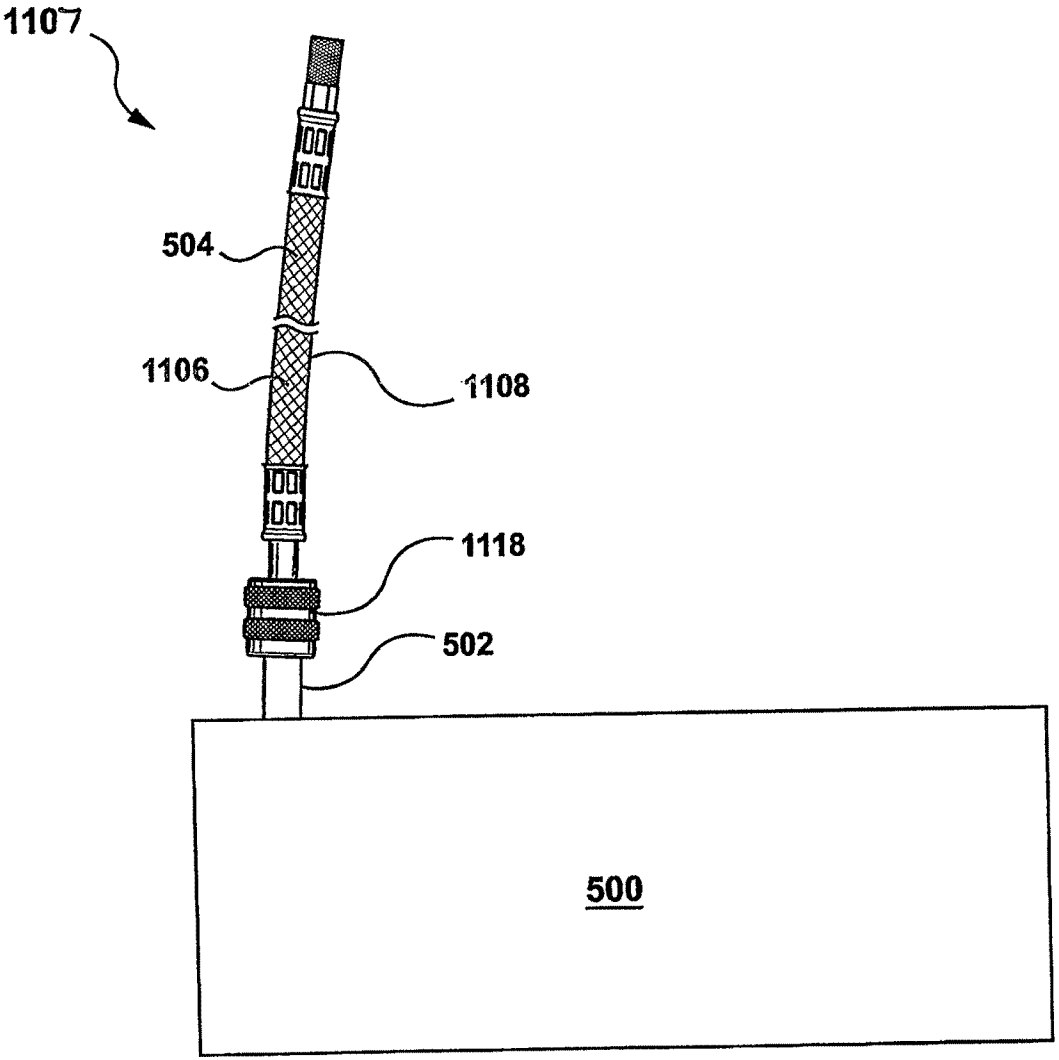
FIG. 10 is a schematic diagram of an embodiment of a fluid introduction device introducing a fluid into a refrigeration system or an air conditioning system according to this disclosure.

Referring to FIG. 10, as the fluid 1106 enters a port 502 of a compressor 500 from the tubing 1108, a refrigerant 504 from the AC/R system 1301 bubbles up into the tubing 1108 to replace the fluid 1106, as the fluid 1106 departs therefrom. In some embodiments, the refrigerant 504 may be in a gaseous state wherein the refrigerant 504 expands into the tubing 1108 and bubbles towards a sealed end of the tubing 108, thereby facilitating a displacement of the fluid 1106 from the tubing 1108. Accordingly, in some embodiments, a volumetric displacement of the fluid 1106 by the refrigerant 504 can provide a force for introducing the fluid 1106 into the AC/R system 1301 the tubing 1108 is coupled to, whether mechanically or fluidly.

In some embodiments, a turbulence of the refrigerant 504 within the AC/R system 1301 to which the device 1107 is connected may create a Venturi effect that assists in an evacuation of the fluid 1106 from the device 1107 and into the AC/R system 1301.

Accordingly, in some embodiments, alternative or additional to using stored or externally added force to add the fluid 1106 to the AC/R system 1301, the device 1107 relies on one or a combination of various effects, where the effects may include (1) a change in stored energy in the device 1107 caused by a change in a pressure between an out of service and in service states of the AC/R system 1301, (2) a volumetric displacement of the fluid 1106 by the refrigerant 504 entering the device 1107, or (3) a Venturi force resulting from a movement of the refrigerant 504 past a service port in the AC/R system 1301.

Figure 11:
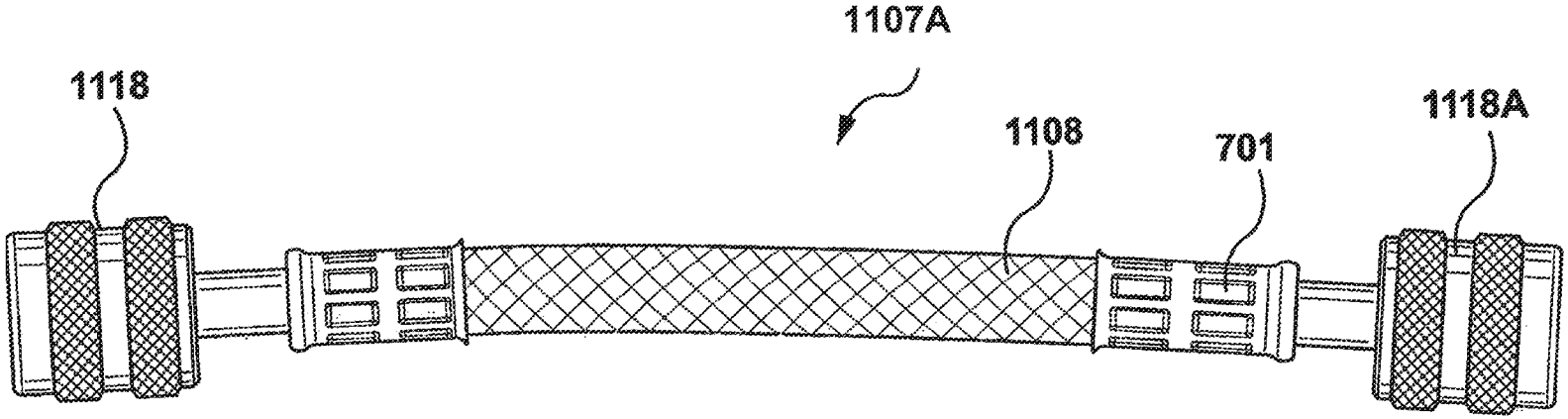
FIG. 11 is a side view of an embodiment of a fluid introduction device for introducing a fluid into a refrigeration system or an air conditioning system according to this disclosure.

Referring to FIG. 11, an alternative embodiment 1107A that is similar to an embodiment described above, except that the bleed valve 1112 on the tubing 1108 has been replaced with a low loss female fitting 1118A. The fitting 1118A is similar or identical to the fitting 1118 except that the fitting 1118A is made for mating with a different diameter service port such that the device 1107A can be used to service a refrigeration system or an air conditioning system that has a different size service ports simply by reversing an orientation of the device 1107A. For example, the fitting 1118 can be a ¼" SAE low loss fitting and the fitting 1118A can be a 5/16" SAE low loss fitting. For example, the fill/discharge fitting 1118 is a ACME automotive 1134A ½" fitting, with the fitting 1118A being either a ¼" SAE low loss fitting or an 1118A 5/16" SAE low loss fitting.

Figure 12:
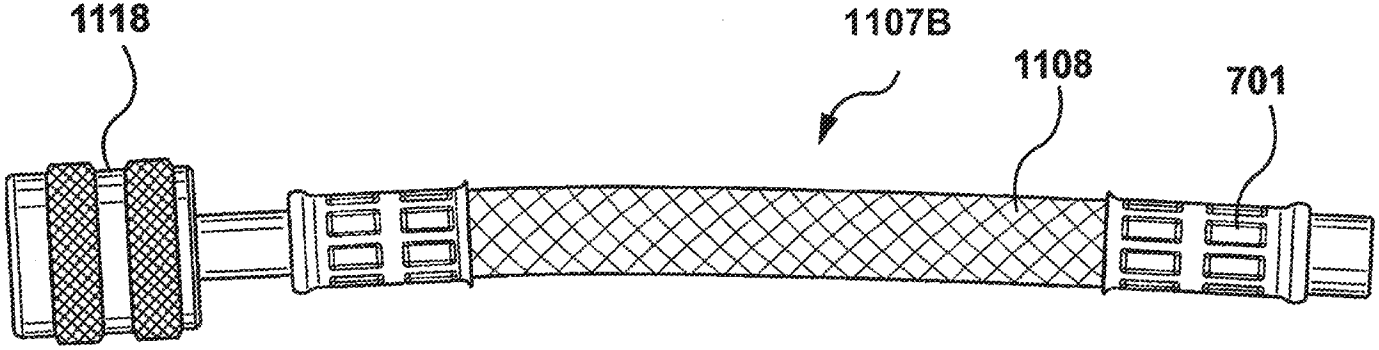
FIG. 12 is a side view of an embodiment of a fluid introduction device for introducing a fluid into a refrigeration system or an air conditioning system according to this disclosure.

FIG. 12 shows yet another alternative embodiment 1107B that is similar to an embodiment described above, except that the bleed valve 1112 on the tubing 1108 has been replaced with a no-valve seal 701.

Figure 13:
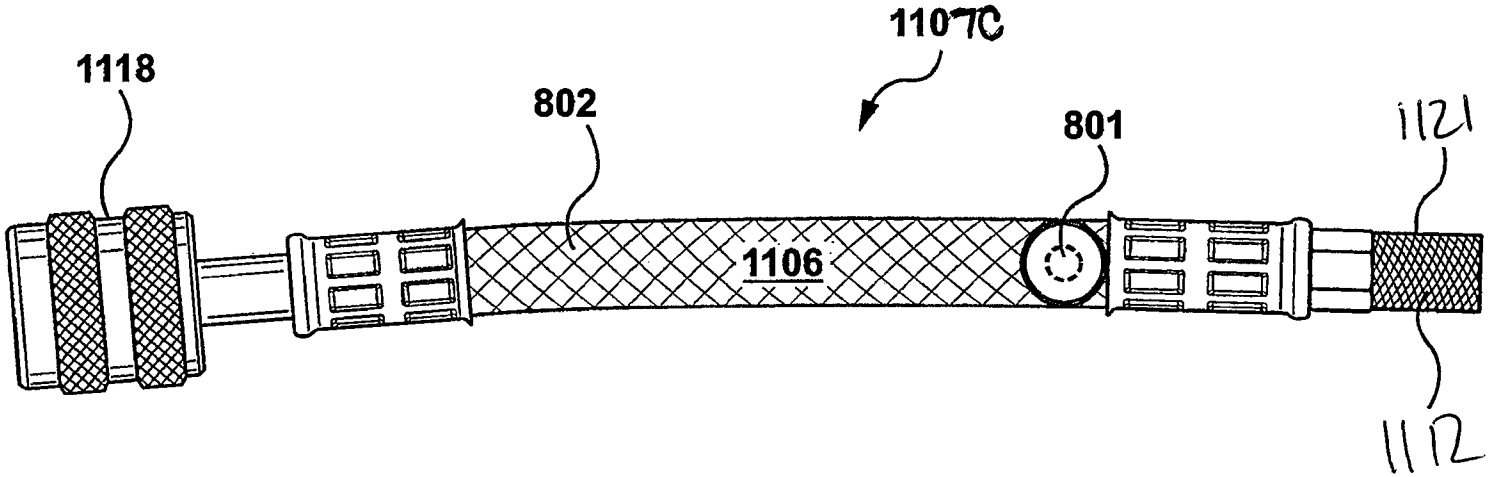
FIG. 13 is a side view of an embodiment of a fluid introduction device for introducing a fluid into a refrigeration system or an air conditioning system according to this disclosure.

FIG. 13 shows still another alternative embodiment 1107C that is similar to an embodiment described above, except that the tubing 1108, which may be flexible, has been replaced with a rigid tube 802. The rigid tube 802 may be transparent or translucent or opaque. A compressible member 801, such as a sphere, is provided at the bleed valve 112 of the device 1107C. The compressible member 801 may function as a mechanical energy storage element to provide a pressure absorbing function when the device 1107C is attached to a low pressure compressor port during an off cycle, and to provide a pressure or energy release function when a compressor is subsequently turned on. In some embodiments, the compressible member 801 helps provide an additional seal to the bleed valve 1121. In some embodiments, an energy storage element is based on an elasticity of the container 1104, where the elasticity is based on a heat generated by a friction resulting for expansion/contraction of the container 1104.

Note that when the rigid tube 802 is used, the compressible member 801 may be omitted. Also, note that the compressible member 801 may be included within the tubing 1108, which may be flexible or elastomeric, of the devices 1107, 1107A or 1107C to enhance an energy absorption and a release feature of the devices 1107, 1107A or 1107C. Also note that a lubricant additive composition for improving a miscibility and a performance of the AC/R system 1301 may be located in a flexible expanding hose or tube that is sealed at one end and at another end includes a two-way flow fitting that can be attached to the AC/R system 1301.

An amount of the fluid 1106 and a discharge rate of the fluid 1106 from the container 1104, as disclosed herein, can be controlled by a number of factors, including (1) a volume and a dimension, such as a length or an internal diameter of the tubing 1108, (2) a size of a valve openings included in the fittings 1116, 1118, and 1118A when in an open state, (3) a characteristic of the fluid 1106, such as a viscosity, or (4) a pressure of the service port 1306 or the hot gas discharge port 1309. For example, at least one of such factors can be calibrated according to a use of the device 1102, at least as disclosed herein, such that a design of the device 1102 can be adapted to accommodate a wide range of fluids, air conditioning systems, or refrigeration systems.

In some embodiments, various devices of FIGS. 1 to 13 can be used to facilitate an introduction of the fluid to an exclusion of an ambient air.

In some embodiments, where the fluid 1106 is colored, a departure of the fluid 1106 is easily observed. In some embodiments, where the tubing 1108, which may be flexible, is used as all or part of the container 1104, a device, as disclosed herein, can be configured or manipulated for a use in a tight area or to connect to different AC/R configurations.

The fill/discharge fitting 1118 can take a number of different configurations. In some embodiments, the fill/discharge fitting 1118 comprises a ¼" SAE low loss fitting. In some embodiments, the fill/discharge fitting 1118 comprises a 5/16" SAE low loss fitting. In some embodiments, the fill/discharge fitting 1118 comprises a 1134A ½" ACME automotive fitting, or any other suitable automotive A/C fitting.

The fluid 1106 could be selected from any number of possible fluids, such as liquids or gases, that are required or useful for maintenance of air conditioning or refrigerant systems. In some embodiments, the fluid 1106 could include an oil, a sealant (including a refrigerant sealant), a leak detection dye (including a fluorescent dye), a refrigerant gas, a performance enhancing fluids, or others. In some embodiments, the fluid 1106 includes a lubricant or a lubricant additive. For example, the lubricant may comprise a refrigeration lubricant. For example, the lubricant additive may comprise an organosilane, an orthoester, an antioxidant, or an anticorrosion additive. For example, a suitable orthoester that may be included in the fluid 1106 as the lubricant additive could comprise a triethylorthoformate. In some embodiments, an organosilane component comprises about 0% to about 20% by weight of the fluid 1106. In some embodiments, the orthoester component or components comprises from about 0% to about 100% by weight of a total amount in any fluid management device disclosed herein.

In some embodiments, the fluid 1106 includes a colorant that allows the fluid 1106 to be easily seen through the tubing 1108, which may be transparent, to allow an easy visual confirmation of a presence of or an amount of the fluid 1106 present in the tubing 1108. For example, such colorant is not a florescent dye, such as used to allow leaks to be detected in a refrigerant system, although in some applications a fluorescent dye may be used, such as a ultraviolet (UV) dye could also be included in the fluid 1106. A suitable non-dye colorant may comprise Chromatint Blue HF or others.

At least some of the additives noted above may function as a drying agent to reduce a moisture level of the lubricant that is included in the fluid 1106. Such use, in some applications, can increase a storage life of the fluid 1106 by mitigating against a breakdown of a chemical component of the fluid 1106.

In some embodiments, the lubricant in the fluid 1106 can function to stop a fluid leak in an air-conditioning system or a refrigeration system that the fluid 1106 is injected into.

In some embodiments, a number of different compositions are possible for the fluid 1106. One possible composition consists of a polyolester lubricant, a triethyl orthoformate, a Vinyltrimethoxysilane, a N-(3-(trimethoxysilyl) propyl)ethylenediamine, methyltrimethoxysilane, a tint solution, or others.

In some embodiments, the fluid 1106 can include a small or a micron size particle, such as a Teflon particle or others.

In some embodiments, there is provided a number of variations of various devices described above for storing or introducing the fluid 1106 into a refrigeration system or an air conditioning system. One such variation enables a cost efficient manufacture and shipping due to a unitary structure of the tubing 1108 having a fitting at each end. For example, the fitting 1118, and 1118A may be directly connected to the container 1104 that stores the fluid 1106 such that no intermediate hoses or fittings are required to move the fluid 1106 from a storage location in the tubing 1108 to the fitting 1118, or 1118A. Thus, the fitting 1118, or 1118A may provide a direct fluid communication between a fluid storage region of the container 1104 (as defined by the tubing 1108) and the service port 1308.

Another such variation may be reusability. For example, a device, as disclosed herein, may be configured for a single use or multiple uses. In such multiple use application, the fitting 1116, 1118, or 1118A may also function as a refill fitting to allow the tubing 1108 to be refilled.

In some embodiments, all or a part of the container 1104 is formed from a rigid component.

In some embodiments, various functions or acts can take place at a given location and/or in connection with the operation of one or more apparatuses or systems. In some embodiments, a portion of a given function or act can be performed at a first device or location, and a remainder of the function or act can be performed at one or more additional devices or locations.

The corresponding structures, materials, acts, and equivalents of all means or step plus function elements in the claims below are intended to include any structure, material, or act for performing the function in combination with other claimed elements as specifically claimed. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the steps can be performed in a differing order or steps can be added, deleted or modified. All of these variations are considered a part of the disclosure. It will be understood that those skilled in the art, both now and in the future, can make various improvements and enhancements which fall within the scope of the claims which follow.

The description of this disclosure has been presented for purposes of illustration and description, but is not intended to be fully exhaustive and/or limited to the disclosure in the form disclosed. Many modifications and variations in techniques and structures will be apparent to those of ordinary skill in an art without departing from a scope and spirit of this disclosure as set forth in the claims that follow. Accordingly, such modifications and variations are contemplated as being a part of this disclosure. A scope of this disclosure is defined by various claims, which include known equivalents and unforeseeable equivalents at a time of filing of this disclosure.

What is claimed is:

1. A device, comprising:

a container, a first fitting, and a second fitting, wherein the container has a first end portion and a second end portion, wherein the container contains a first fluid between the first end portion and the second end portion, wherein the first end portion hosts the first fitting, wherein the second end portion hosts the second fitting, wherein the first fitting is configured for directly and detachably connecting to a service port of a system that is running, wherein the system is an air conditioning system or a refrigeration system, wherein the system is residential or commercial, wherein the second fitting is configured for detachably connecting to a source of a second fluid, wherein the first fluid is input into the service port of the system that is running from the first fitting directly and detachably connected to the service port of the system that is running when urged via the second fluid entering the container from the source via the second fitting while the system is running, wherein the first fitting or the second fitting includes a metal, a mineral, an amorphous material, a ceramic, a glass ceramic, an organic solid, a wood, a polymer, a rubber, a composite material, a semiconductor, a nanomaterial, or a biomaterial.

2. The device of claim 1, wherein the container is a single container.

3. The device of claim 1, wherein the container includes a first container and a second container, wherein the first container and the second container are connected in series, wherein the first container includes the first fitting, wherein the second container includes the second fitting, wherein the first container and the second container extend between the first fitting and the second fitting.

4. The device of claim 1, wherein the first fitting is a female fitting, wherein the second fitting is a male fitting.

5. The device of claim 1, wherein the first fluid includes a leak sealant.

6. The device of claim 1, wherein the first fluid includes a UV dye.

7. The device of claim 1, wherein the first fluid includes a lubricant.

8. The device of claim 1, wherein the source is a tube connected to a manifold in fluid communication with the system.

9. The device of claim 1, wherein the service port is a first service port pressurized at a first pressure, wherein the source is a second service port of the system pressurized at a second pressure, wherein the first pressure is lower than the second pressure, wherein the second fitting is indirectly fluidly connectable to the source.

10. The device of claim 1, wherein the first fluid includes a leak sealant, wherein the first fitting is a female fitting, wherein the second fitting is a male fitting, wherein the container includes a portion that is transparent or translucent between the first fitting and the second fitting such that the first fluid is externally visible within the container before the first fluid is input into the service port of the system that is running from the first fitting directly and detachably connected to the service port of the system that is running when urged via the second fluid entering the container from the source via the second fitting while the system is running.

11. The device of claim 10, wherein the source is a tube connected to a manifold in fluid communication with the system.

12. The device of claim 10, wherein the service port is a first service port pressurized at a first pressure, wherein the source is a second service port of the system pressurized at a second pressure, wherein the first pressure is lower than the second pressure, wherein the second fitting is indirectly fluidly connectable to the source.

13. The device of claim 1, wherein the system is the air conditioning system.

14. The device of claim 1, wherein the system is the refrigeration system.

15. The device of claim 1, wherein the first fluid includes an oil.

16. The device of claim 1, wherein the first fluid includes an oil additive.

17. The device of claim 1, wherein the first fluid includes a refrigerant.

18. The device of claim 1, wherein the first fluid includes an organosilane, an orthoester, an antioxidant, or an anti-corrosion additive.

19. The device of claim 1, wherein the first fluid includes an additive functionable as a drying agent to reduce a moisture level of a lubricant.

20. A method, comprising:

providing a device to a user, wherein the device includes a container, a first fitting, and a second fitting, wherein the container includes a first end portion and a second end portion, wherein the container contains a first fluid between the first end portion and the second end portion, wherein the first end portion hosts the first, wherein the second end portion hosts the second fitting, wherein the first fitting or the second fitting includes a metal, a mineral, an amorphous material, a ceramic, a glass ceramic, an organic solid, a wood, a polymer, a rubber, a composite material, a semiconductor, a nanomaterial, or a biomaterial, wherein the device is provided to the user such that the user is enabled to:

(i) directly and detachably connect the first fitting to a service port of a system that is running, wherein the system is an air conditioning system or a refrigeration system, wherein the system is residential or commercial, (ii) detachably connect the second fitting to a source of a second fluid, and (iii) input the first fluid into the service port of the system that is running from the first fitting directly and detachably connected to the service port of the system that is running as urged via the second fluid entering the container from the source via the second fitting while the system is running.

* * * * *